United States Patent [19]

DeLoach

[11] Patent Number: 4,682,613

[45] Date of Patent: Jul. 28, 1987

[54] LOOSE FILL MEDIA CLEANING APPARATUS

[75] Inventor: Anthony DeLoach, Sarasota, Fla.

[73] Assignee: Water Equipment Services, Inc., Sarasota, Fla.

[21] Appl. No.: 888,386

[22] Filed: Jul. 23, 1986

[51] Int. Cl.[4] ..... B08B 3/06

[52] U.S. Cl. ..... 134/58 R; 134/109; 134/135; 134/148; 134/153; 134/155; 134/159; 134/160; 209/260; 209/270

[58] Field of Search ..... 134/58 R, 109, 135, 134/140, 147, 148, 153, 154, 155, 157, 159, 160, 163; 209/260, 270; 68/58, 148, 152, 210

[56] References Cited

U.S. PATENT DOCUMENTS

| | | | |
|---|---|---|---|
| 930,654 | 8/1909 | Emerson | 134/157 |
| 2,428,489 | 10/1947 | Goodreau | 68/210 |
| 3,014,315 | 12/1961 | Clayton | 134/153 |
| 3,348,557 | 10/1967 | Adamson | 134/158 X |
| 3,439,806 | 4/1969 | Kass et al. | 209/260 |
| 3,448,747 | 6/1969 | Isaacson | 134/153 X |
| 3,521,650 | 7/1970 | Barton et al. | 134/153 X |
| 3,680,570 | 8/1972 | Nobili | 134/153 X |
| 3,815,615 | 6/1974 | Holm | 134/159 X |

*Primary Examiner*—Philip R. Coe

*Attorney, Agent, or Firm*—Charles J. Prescott; Raymond H. Quist

[57] ABSTRACT

A foraminated cylindrical container has a loading port into which loose fill media may be loaded for cleaning. The container is rotated to tumble the media and a pan for containing solvent is located so that the media will be immersed during rotation. A hose supplied by a high pressure pump is used to further clean the media. The container may be raised and tilted to facilitate removal of the media. The solvent may be pumped from the pan to a storage tank. Separate switches are provided for the pumps and the rotation and hoisting mechanism so that the operator can adjust the timing of each portion of the cycle as needed to complete the cleaning.

17 Claims, 5 Drawing Figures

LOOSE FILL MEDIA CLEANING APPARATUS

BACKGROUND OF THE INVENTION

1. Field of the Invention

This invention relates generally to apparatus for cleaning loose fill media, and more particularly to apparatus for cleaning loose fill media of the type used in aeration, degasification, odor control and air stripping towers.

2. Description of Related Art

A widely used method for removing contaminents from liquids or gases is to pass liquid down through a tower containing loose fill or random pack media which causes the liquid to separate into drops. As the liquid descends in the tower, gas is passed in reverse flow through the tower from the bottom so as to intimately contact the liquid. The particular loose fill media and the liquids and gases which are used in a tower are selected in accordance with the liquid or gas to be decontaminated and the contaminents contained therein.

The towers may be constructed of various materials such as stainless steel, aluminum or fiberglass. The loose fill media is typically fabricated of polypropylene, polystyrene, stainless steel, etc. It is intended by the use of these materials that the inside surface of the tower and the loose fill media will not become fouled by the liquid being cleaned nor the contaminents being removed. Despite this intent, the loose fill media eventually becomes so fouled and clogged that the tower will no longer effectively perform its function. At this time, the loose fill media is removed and generally discarded, to be replaced with new loose fill media.

The loose fill media has a large volume and low density foraminated structure, and is available in various sizes. The contaminents which foul the loose media are susceptible of being removed, but the many crevices of the media make cleansing difficult. Placing the media in a bath of a suitable solvent is not effective because many of the types of media float, leaving surfaces which are not exposed to the solvent. Moreover, mere soaking is not effective for contaminent removal.

Although large quantities of the loose fill media are used in a typical tower, the difficultly in economically cleaning the media has caused much of the media to be discarded once it becomes contaminated.

In the past various devices have been disclosed for the treatment of bulk materials such as by washing, separating or exposing to other materials.

U.S. Pat. No. 402,845, Loughran, entitled "Gravel Screen", discloses a cylindrical screen which is rotated and inclined so that gravel introduced at the higher end will move to the lower end. Buckets at the lower end raise the gravel to a chute to remove it. The cylindrical screen is partially immersed in a tank of water.

U.S. Pat. No. 468,247, Jewett, entitled "Machine for Washing and Grading Gravel", discloses a cylindrical screen with a hopper positioned above the screen. Gravel is deposited in the hopper and is moved onto the screen impelled by water. Finer gravel passes through the screen and onto an interior chute to be removed at the end of the cylinder. Coarse material is carried on the outside of the cylindrical screen and falls off. The screen tends to rotate due to the impinging water and gravel.

U.S. Pat. No. 483,030, Volstorf, entitled "Rotary Pulp Strainer", discloses an annular strainer which is inclined and partially submerged in a tank of liquid.

Pulp material is fed to the lower portion of the strainer through a central funnel and moves upward on a helical blade as the cylinder rotates, and is then discharged.

U.S. Pat. No. 3,133,832, Pellhammer, entitled "Impregnation of Fibrous Material", discloses an outer rotating drum surrounding an inner fixed drum with fibrous material carried around the annular space by the outer drum. The drum is immersed in a liquid which impregnates the fibrous material.

U.S. Pat. No. 3,392,828, Muller, entitled "Separation of Substances", discloses an inclined, rotating cylindrical screen in which materials of different sizes and densities are separated. Lighter particles are carried out with liquid, smaller dense particles pass through the screen and are collected in a hopper and large particles are carried by vanes to be deposited on a chute.

U.S. Pat. No. 3,909,291, Leong, entitled "Comestible Cleaning Apparatus", discloses a cylindrical wire mesh basket which is rotated in a tank of water. Bean sprouts to be cleaned are placed in the basket. The floating bean sprouts are struck by vanes in the basket causing debris to separate and be carried off.

U.S. Pat. No. 4,184,944, Tytko, entitled "Rotary Screen Appliance", discloses a cylindrical screen for sifting sand which can be secured to a cement mixer for rotation therewith and permits tilting of the screen for dumping the residue.

The foregoing devices are typically designed to provide a continuous operation wherein new material to be processed may be continuously introduced at one location, and the already processed material is continuously expelled at another location. These structures do not accommodate the cleaning of materials wherein different materials may be held in separate steps of the cleaning process for times which can be modified as necessary for effective cleaning.

It is therefore an object of this invention to provide loose fill media apparatus which provides immersion of the media in an appropriate solvent for a time which can be controlled by an operator and which also provides a spray washing and rinsing of the media while it is not immersed for time which can be controlled by an operator.

It is a further object of this invention to provide apparatus which will tumble the media either intermittently or continuously for times which can be controlled by an operator to enhance the effectiveness of the spray washing.

It is also an object of this invention to provide apparatus which has a foraminated cylinder which can be moved between an immersion position and a position for spray washing and media removal.

In accordance with these and other objects, which will become apparent hereafter, the instant invention will now be described with reference to the accompanying drawings.

SUMMARY OF THE INVENTION

Apparatus is provided for cleaning loose fill media which has become fouled with various contaminents and to various degrees. The cleaning involves the operations of loading the media, immersing the media in a solvent, tumbling the media, spraying the media with a solvent at high pressure and unloading the media. The operator can control all aspects of the operations such as the quantity of media to be loaded, the times for immersion, tumbling and spraying, and may repeat any of the separate operations, as needed to achieve satisfactory cleaning of the media. The apparatus provides this flexibility by having separate switches for starting and stopping the pumps and motors employed in the apparatus. A foraminated cylindrical container is mounted on a platform for rotation at a relatively low speed. A portion of the container passes through a pan containing a liquid solvent of the particular type useful in removing the contaminent which has fouled the media. A first pump is provided to transfer this liquid from the pan to a storage tank. A second pump delivers liquid at high pressure to be sprayed on the media. A hoist raises one end of the container to facilitate the unloading of the cleaned media.

DETAILED DESCRIPTION OF THE INVENTION

Figure 1:
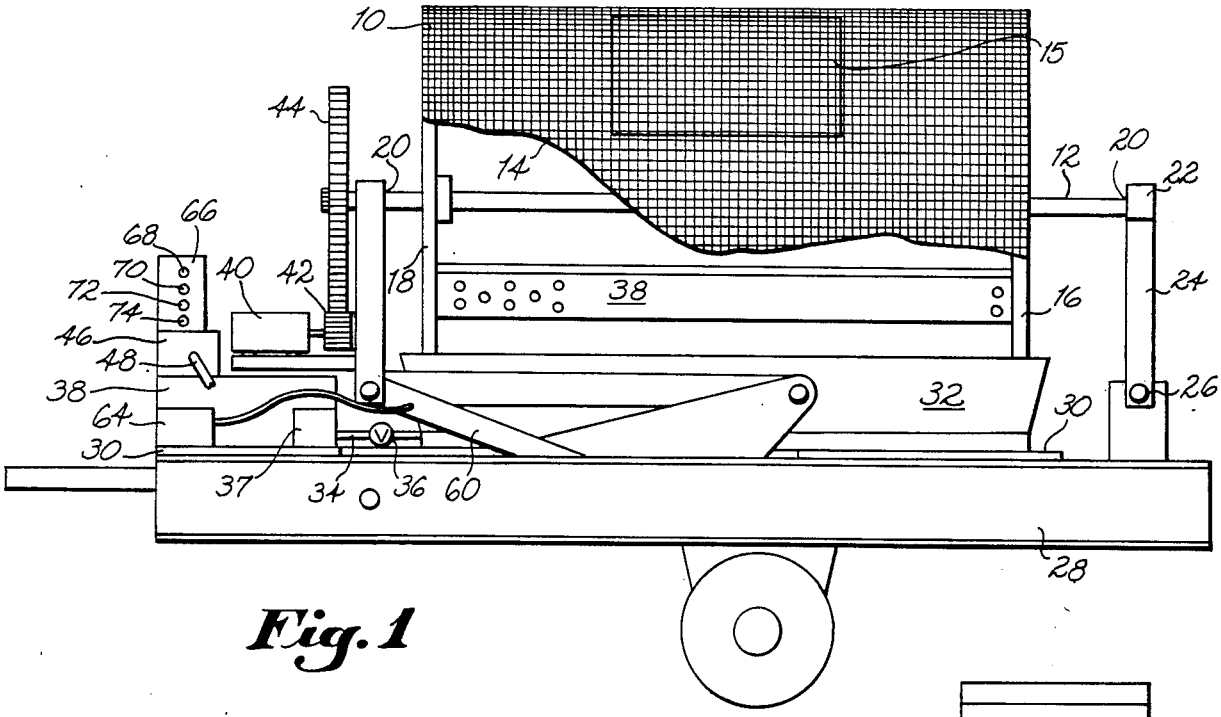
FIG. 1 is a side elevation of a loose fill media cleaning apparatus in accordance with the invention.
Figure 2:
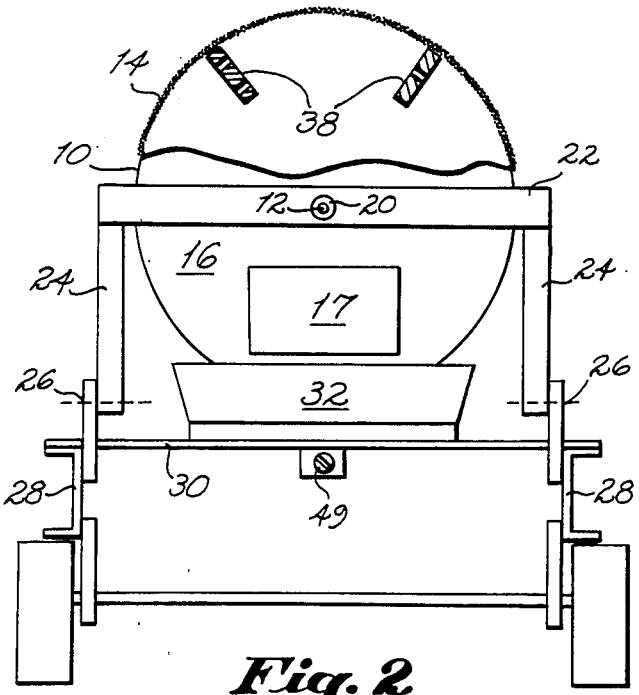
FIG. 2 is an elevation of the right end of the apparatus of FIG. 1.

Referring to FIGS. 1 and 2, foraminated cylinder 10 is shown mounted on shaft 12 for rotation about the longitudinal axis of shaft 12. Cylinder 10 has a side wall 14 which may be screen, expanded metal or other perforated material, the objective being to contain loose fill media having a major dimension of as small as one inch while still providing substantial open area for the admission of cleaning fluid. Side wall 14 of cylinder 10 has a loose fill media filling port with a closure 15. Cylinder 10 also has an end wall 16 at one end and an end wall 18 at the other end. End wall 16 has a loose fill media with closure 17. Closures 15 and 17 may be fitted with any desired fastening devices.

Shaft 12 is provided with bearings 20 located outside of cylinder 10. Bearing 20, adjacent to end wall 16, is positioned in laterally extending bearing support beam 22. Legs 24 depend from each end of beam 22. Legs 24 have a pivotal support 26 at the bottom which pivotally secures them to the apparatus support base. The apparatus support base includes a pair of spaced, longitudinally extending beams 28 and a platform 30, supported by and extending between said beams. Platform 30 has openings to permit a hoist arrangement also supported by beams 28 to operate.

Positioned on platform 30 and located beneath cylinder 10 is liquid holding and collecting pan 32. Pan 32 is designed to hold a liquid in which to immerse a portion of cylinder 10 and the loose fill media in that portion of the cylinder. Because cylinder 10 is caused to rotate, media in other portions of cylinder 10 will also be periodically immersed in the liquid. Pan 32 is also designed to collect liquid which drips from cylinder 10 and the contained media. This liquid will be carried from pan 32 as it rotates and will also be sprayed on the media as will be described later. Pan 32 is provided with outwardly inclined, removeable walls to assist in the collection of liquid which splashes from cylinder 10. Pan 32 can be drained by transfering the liquid through conduit 34, having valve 36 connected therein, to tank 38, using pump 37. With the liquid drained from pan 32, it is possible to remove any or all of the sides of pan 32, such as the side extending across the back. This expedient is not necessary if the sides of pan 32 do not extend excessively high, for cylinder 10 is raised for unloading the loose fill media therefrom. Liquid contained within tank 38 may be sprayed upon the loose fill media contained in cylinder 10 through the use of pump 46 which delivers the liquid through hose 48. Tank 38 may contain the solvent or clean water for rinsing. Separate tanks 38 which provide storage for both solvent and clean water are preferred, so that any solvent remaining on the loose fill media can be rinsed off. It has been found that a pump which provides the liquid at a pressure of 2000 pounds per square inch is effective. Because some of the contaminents will flake off or precipitate as sludge, a sludge removal drain 49 is provided at the bottom of pan 32.

Also contained within cylinder 10 are longitudinally extending paddles 38 which enhance the tumbling of the loose fill media while cylinder 10 rotates. Paddles 38 are perforated to reduce resistence as cylinder 10 rotates through the liquid in pan 32. These perforations are also desirable to minimize the amount of liquid which will be carried from pan 32 as cylinder rotates. It should be recognized that some contaminent removing liquids are acid based and their potency is reduced by excessive exposure to air.

Cylinder 10 is caused to rotate by motor 40 through spur gears 42 and 44 which cause cylinder 10 to rotate at a relatively low speed of 4 to 6 revolutions per minute.

Because the loose fill media which are cleaned by the apparatus of this invention will have various contaminents and will be contaminated to greater and lesser degrees, the apparatus of this invention provides complete operator control of the times during which an immersion bath is provided, the cylinder is rotated and the spray is applied. Thus the operator may continue the immersion bath for any time which appears to be necessary, and may similarly regulate the time, or even the number of times, that any of the cleaning operations are performed.

Figure 4:
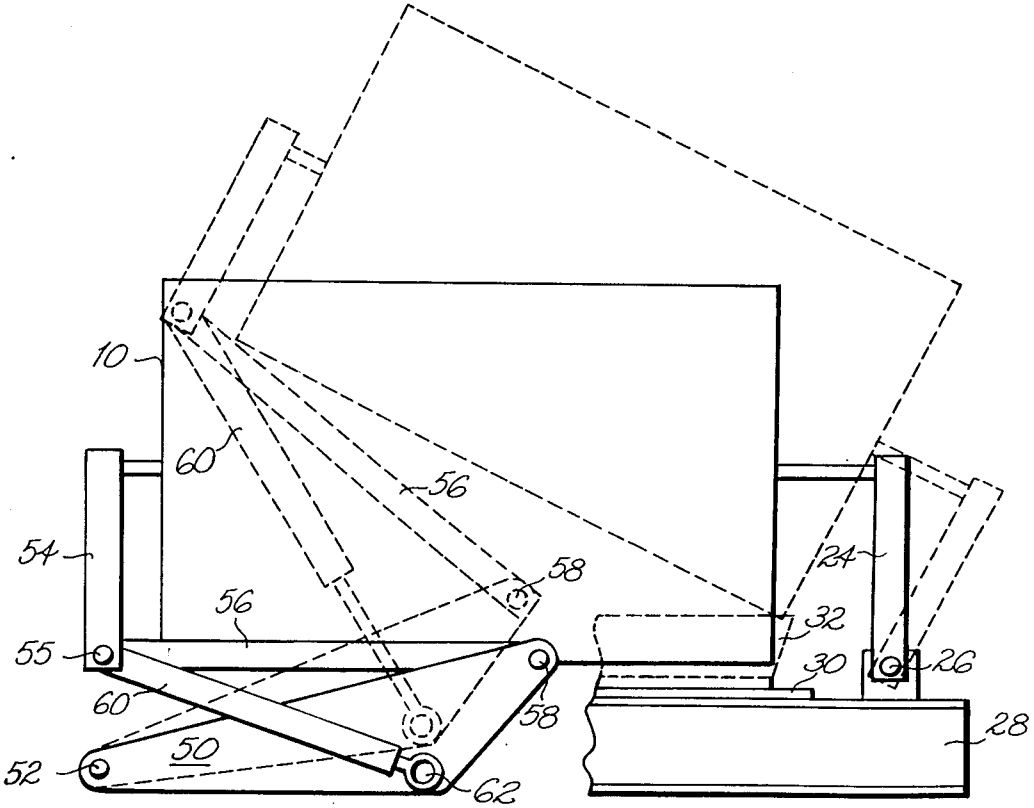
FIG. 4 is a side elevation of the apparatus shown in FIG. 3, showing the elevated position in broken lines.
Figure 3:
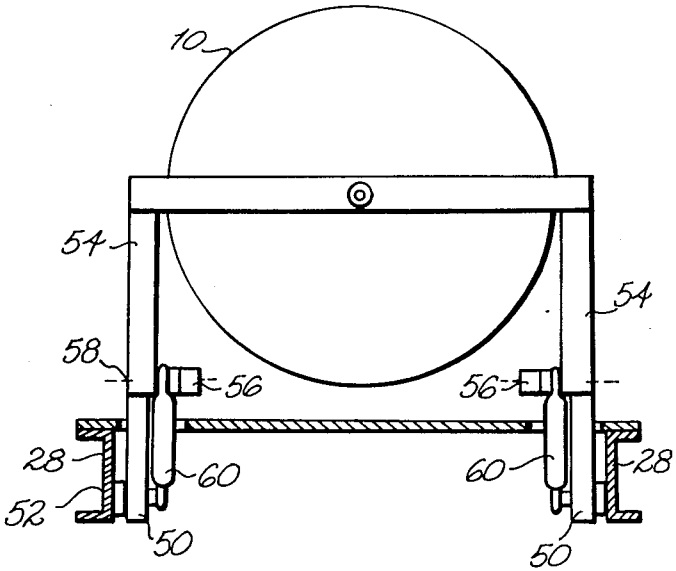
FIG. 3 is an elevation of the apparatus of FIG. 1 providing a detail of the hoist apparatus.

Turning now to FIGS. 3 and 4, cylinder 10 is provided with a hoist device to permit cylinder 10 to be raised out of pan 32 and tilted to facilitate removal of cleaned loose media. Cylinder 10 is shown in FIG. 3 in its cleaning position in solid lines and in its unloading position in broken lines. Pivotal support 26 is at the end of cylinder having the loose media removal port. It will be noted that pivotal support 26 is at the bottom of depending leg 24. Changing the location of pivotal support 26 will change the elevated position of cylinder 10 and also the path it will follow in moving to this position. The hoist includes cranks 50 which have pivots 52 which are fixed in beams 28. Legs 54 have a pin 55 connection at the bottom to one end of fixed length links 56. Cranks 50 have a pin connection 58 to the other end of fixed length links 56. Telescoping cylinders 60 are also connected at one end to pin connection 55, and at the other end have a pin connection 62 to cranks 50. Cylinders 60 may be hydraulically or pneumatically operated to raise and lower cylinder 10.

Referring again to FIG. 1, cylinders 60 are connected to a source of hydraulic or pneumatic pressure 64.

Control panel 66 provides switch 68 which controls raising and lowering cylinder 10, switch 70 which starts and stops motor 40, switch 72 which controls pump 37 and switch 74 which controls pump 46. Because of this arrangement of switches, an operator has complete control over the timing of the operation of the cleaning apparatus.

The need for a loose fill media cleaning apparatus at various locations where air stripping towers and the like are located varies. Thus it may be economically feasible to have a cleaning apparatus dedicated to a single location. In other cases, a need for the apparatus may occur only occasionally so a trailer mounted apparatus such as shown in FIGS. 1 and 2 may be useful.

It should be recognized that the types of solvents which are useful to remove different types of contaminents are well known and so will not be described herein. However, the design of the apparatus is such that one solvent can be removed to be replaced by another.

Figure 5:
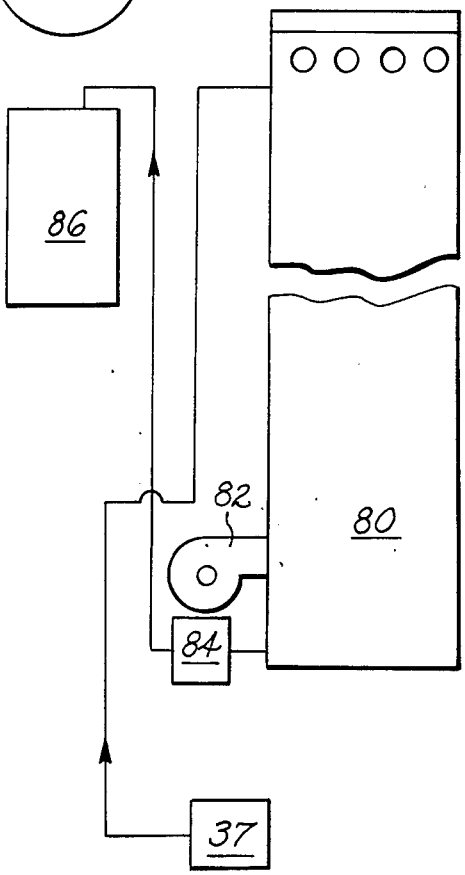
FIG. 5 is a schematic elevation of apparatus for cleaning the solvent used in the apparatus.

Referring to FIG. 5, after the solvents have been used in cleaning loose fill media for some time, it becomes necessary to replace or recycle the solvents. Pump 37 is used to pump contaminated solvent to the top of air stripping tower 80. Tower 80 contains loose fill media and ambient air may be introduced by blower 82 to remove volatile material from the solvent as it trickles to the bottom of tower 80. It is then pumped by pump 84 to a storage tank 86 for later use. The air stripping tower can be used to convert acidic liquids to a normal pH, or can be used to remove chloring, etc. So that some liquids can be put in a form where disposal will not be environmentally harmful.

While the instant invention has been shown and described herein in what is conceived to be the most practical and preferred embodiment, it is recognized that departures may be made therefrom within the scope of the invention, which is therefore not to be limited to the details disclosed herein, but is to be afforded the full scope of the claims so as to embrace any and all equivalent apparatus and articles.

I claim:

1. Loose fill media cleaning apparatus comprising:

a foraminated hollow cylinder having a shaft extending along its longitudinal axis;

an imperforate disk positioned at each end of said cylinder providing end walls for said cylinder and support for said cylinder;

a first bearing at one end of said shaft and a second bearing at the other end of said shaft for supporting said shaft for rotation about its axis;

said cylinder having a loose fill media filling port with a closure in the cylinder wall, and said cylinder having in said disk at said one end a loose fill media removing port with a closure;

first bearing support means having a laterally extending bearing support beam with a leg depending from each end of said beam whereby an area for access to said loose fill removing port is provided between said depending legs and below said beam;

an apparatus support base;

pivotal support means pivotally connecting said depending legs of said first bearing support means to said apparatus support base;

hoist means for moving said second bearing between a position where it is at the same level as said first bearing and a position where it is elevated above said first bearing;

a liquid holding and collecting pan positioned below said cylinder on said apparatus support base;

a liquid storage tank on said support base;

first pump means for transfering liquid from said liquid holding and collecting pan to said liquid storage tank;

second pump means for delivering liquid from said liquid storage tank at elevated pressure;

propulsion means for rotating said cylinder on said shaft at a relatively slow speed; and switch means for controlling the operation of said hoist means, said first and second pump means, and said propulsion means whereby an operator can control the times for operation.

2. Loose fill media cleaning apparatus in accordance with claim 1 further including:

second bearing support means at the other end of said cylinder having a laterally extending bearing support beam with a leg depending from each end of said beam; and said hoist means applies lifting force to said depending legs.

3. Loose fill media cleaning apparatus in accordance with claim 1 further including:

trailer means upon which said apparatus support base is mounted.

4. Loose fill media cleaning apparatus in accordance with claim 1 further including:

longitudinally extending paddles positioned within said cylinder for enhancing the tumbling of said loose fill media while said cylinder rotates.

5. Loose fill media cleaning apparatus in accordance with claim 1 wherein:

said foraminated hollow cylinder has a sidewall formed of screen.

6. Loose fill media cleaning apparatus in accordance with claim 1 wherein said foraminated hollow cylinder has a sidewall formed of expanded metal.

7. Loose fill media cleaning apparatus in accordance with claim 1 wherein said liquid holding and collecting pan has removable sides.

8. Loose fill media cleaning apparatus in accordance with claim 1 further including an air stripping tower;

a blower for blowing air into the bottom of said tower;

a conduit connecting the top of said air stripping tower to said first pump means, whereby said solvent from said pan may be passed through said tower; and third pump means for pumping solvent which has passed through said tower.

9. Loose fill media cleaning apparatus comprising:

apparatus support means for supporting said apparatus;

a foraminated cylindrical container mounted on said apparatus support means for rotation about the longitudinal axis of said container;

propulsion means for rotating said container at a relatively slow speed;

a first switch for starting and stopping said propulsion means;

media filling means for introducing media to be cleaned into said container;

media removing means for removing cleaned media from said container;

hoist means for raising and lowering one end of said container;

second switch means for causing said hoist means to raise and lower said container;

a liquid holding and collecting pan positioned below said container on said apparatus support means;

a liquid storage tank;

conduit means for connecting said liquid holding and collecting pan to said liquid storage tank;

a first pump for pumping liquid from said liquid holding and collecting pan to said liquid storage tank;

third switch means for starting and stopping said first pump;

a second pump for delivering liquid from said liquid storage tank at elevated pressure; and fourth switch means for starting and stopping said second pump.

10. Loose fill media cleaning apparatus in accordance with claim 9 wherein:

said container has a shaft extending along its longitudinal axis;

a first bearing at one end of said shaft and a second bearing at the other end of said shaft;

a first laterally extending beam having depending legs at each end supporting said first bearing;

a second laterally extending beam having depending legs at each end supporting said second bearing; and said hoist means applies lifting force to said legs depending from said second laterally extending beam.

11. Loose fill media cleaning apparatus in accordance with claim 9 further including:

trailer means upon which said apparatus support base is mounted.

12. Loose fill media cleaning apparatus in accordance with claim 9 further including:

longitudinally extending paddles positioned within said container for enhancing the tumbling of said loose fill media while said container rotates.

13. Loose fill media cleaning apparatus in accordance with claim 9 wherein:

said foraminated hollow container has a sidewall formed of screen.

14. Loose fill media cleaning apparatus in accordance with claim 9 wherein:

said foraminated hollow container has a sidewall formed of expanded metal.

15. Loose fill media cleaning apparatus in accordance with claim 9 wherein:

said liquid holding and collecting pan has removable sides.

16. Loose fill media cleaning apparatus in accordance with claim 9 further including;

an air stripping tower;

a blower for blowing air into the bottom of said tower;

a conduit connecting the top of said air stripping tower to said first pump means, whereby said solvent from said pan may be passed through said tower; and third pump means for pumping solvent which has passed through said tower.

17. Loose fill media cleaning apparatus comprising:

apparatus support means for supporting said apparatus;

said apparatus support means including a pair of spaced beams having a platform extending between them;

a container having a foraminated sidewall and imperforate ends;

a shaft extending through said container along the longitudinal axis of said container;

a first bearing at one end of said shaft having first support means for holding said first bearing at a position above said spaced beams;

said first support means including pivots;

a second bearing at the other end of said shaft having second support means for holding said second bearing at a position above said spaced beams;

hoist means for raising said second support means to tilt said container;

propulsion means for rotating said container;

a liquid holding and collecting pan positioned below said container on said platform;

a liquid storage tank;

first pump means for transfering liquid from said liquid holding and collecting tank to said liquid storage tank;

hose means for conveying liquid to be sprayed on media within said container;

second pump means for supplying liquid at high pressure to said hose means; and switch means for separately controlling the operation of said first and second pump means, said propulsion means and said hoist means.

* * * * *